US006477941B1

(12) United States Patent
Zhu et al.

(10) Patent No.: US 6,477,941 B1
(45) Date of Patent: Nov. 12, 2002

(54) DUAL GALLERY PISTON

(75) Inventors: Xilou Zhu, Ann Arbor, MI (US); Alan S. Brown, Sumter, SC (US); Walter Joseph Griffiths, Lymington (GB); Miguel N. Azevedo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/684,127

(22) Filed: Oct. 6, 2000

Related U.S. Application Data

(60) Provisional application No. 60/158,510, filed on Oct. 8, 1999.

(51) Int. Cl.[7] ..... F01B 31/08
(52) U.S. Cl. ..... 92/186; 92/231
(58) Field of Search ..... 92/186, 222, 231

(56) References Cited

U.S. PATENT DOCUMENTS

| | | | | |
|---|---|---|---|---|
| 1,479,816 | A | | 1/1924 | Jorgensen |
| 1,547,687 | A | | 7/1925 | Rohwer |
| 1,763,625 | A | | 6/1930 | Mellor |
| 1,779,555 | A | | 10/1930 | Minnick |
| 2,170,266 | A | | 8/1939 | Leissner |
| 2,304,891 | A | | 12/1942 | Dickson |
| 2,407,429 | A | | 9/1946 | Kuttner |
| 2,687,931 | A | | 8/1954 | Flynn, Jr. |
| 2,759,461 | A | | 8/1956 | Maybach et al. |
| 2,772,933 | A | | 12/1956 | Nichols |
| 2,819,936 | A | | 1/1958 | Cambeis |
| 2,865,348 | A | | 12/1958 | Krammer et al. |
| 3,215,130 | A | | 11/1965 | Maier |
| 3,385,175 | A | | 5/1968 | Meier et al. |
| 3,613,521 | A | | 10/1971 | Itano |
| 3,877,351 | A | | 4/1975 | Barfiss |
| 3,930,472 | A | | 1/1976 | Athenstaedt |
| 4,175,502 | A | | 11/1979 | Moebus |
| 4,286,505 | A | | 9/1981 | Amdall |
| 4,356,800 | A | | 11/1982 | Moebus |
| 4,368,697 | A | | 1/1983 | Moebus |
| 4,517,903 | A | | 5/1985 | Nakano et al. |
| 4,517,930 | A | * | 5/1985 | Nakano et al. ..... 92/186 |
| 4,532,686 | A | | 8/1985 | Berchem |
| 4,581,983 | A | * | 4/1986 | Moebus ..... 92/186 |
| 4,587,932 | A | | 5/1986 | Moebus |
| 4,635,596 | A | | 1/1987 | Nakano et al. |
| 4,662,319 | A | | 5/1987 | Ayoul |
| 5,309,818 | A | * | 5/1994 | Mendes et al. ..... 92/176 |
| 5,906,182 | A | | 5/1999 | Blase et al. |

* cited by examiner

*Primary Examiner*—Edward K. Look
*Assistant Examiner*—Thomas E. Lazo
(74) *Attorney, Agent, or Firm*—Reising, Ethington, Barnes, Kisselle, Learman & McCulloch P.C.

(57) ABSTRACT

A heavy duty diesel piston includes upper and lower portions joined across a friction weld and internally contoured to provide a dual gallery structure including an outer annular gallery and a central gallery joined by passages for communicating cooling oil therebetween. The dual-gallery structure allows oil to enter from the outer gallery, which is formed by the circumferential annular recess in the crown and crown bottom, into the central gallery to cool the piston and particularly the central crown region exposed to hot combustion gases. The friction weld provides high structural integrity and minimizes the number of manufacturing steps need to attach the crown to the crown bottom.

24 Claims, 3 Drawing Sheets

DUAL GALLERY PISTON

This application claims the benefit of U.S. Provisional Application No. 60/158,510, filed Oct. 8, 1999.

BACKGROUND OF THE INVENTION

1. Technical Field

The present invention is directed to pistons for heavy duty diesel engine applications, and more particularly to the formation of such pistons having internal galleries for cooling oil.

2. Related Art

Piston structures having two closed galleries are known, for example, in U.S. Pat. Nos. 3,613,521; 4,581,983; 4,662,319; and 4,532,686.

In each of the patents, upper and lower crown parts are separately formed and then joined across mating surfaces to define an inner and outer chamber within the piston body. In U.S. Pat. No. 3,613,521, the crown parts are joined by brazing through provision of a gap at the bottom of annular grooves machined in the lower crown part in which annular ribs of the upper crown part are received. U.S. Pat. No. 4,581,983 joins the upper crown part to the lower crown part by means of charge carrier rays. U.S. Pat. No. 4,662,319 presents a complex arrangement of internal chambers and passages which would be extremely costly to produce. U.S. Pat. No. 4,532,686 provides dual chambers but which are not in fluid communication with one another for the flow of cooling oil from one chamber to the other.

It is an object of the present invention to improve upon dual gallery pistons to provide an efficient, robust piston structure.

SUMMARY OF THE INVENTION

According to a first aspect of the invention, an articulated piston assembly for heavy duty diesel engine applications is provided comprising a piston body including a one piece upper crown part and a one piece lower crown part in conjunction with an articulated piston skirt provided as a separate structure from the piston body. The upper crown part has a lower connecting portion formed with inner and outer annular ribs which are spaced from one another and extend axially to free ends each presenting a planar joining surface of the ribs. The lower crown part has an upper connecting portion from which a pair of pin boss portions depend having a space between them to receive a connecting rod. The upper connecting portion has inner and outer annular ribs extending axially to free ends thereof each presenting a planar joining surface of the lower crown part ribs. The lower crown part further has an inner gallery floor arranged above the space between the rib bosses and surrounded by the inner annular rib of the lower crown part. According to the invention, the inner and outer ribs of the upper and lower crown parts are joined across their respective joining surfaces by friction weld joints to define an inner and outer oil gallery within the joined crown parts separated by the inner ribs. The inner rib of the lower crown part is formed with at least one fluid transfer port spaced axially from the joining surface thereof and extending between the outer oil gallery and the inner oil gallery to establish fluid communication therebetween.

The inner gallery floor includes an opening establishing fluid communication between the inner gallery and the space between the pin bosses.

According to a further aspect of the invention, a monobloc piston assembly for heavy duty diesel engine applications is provided having one piece upper and lower crown parts sharing the same features as the articulated piston above, except that in place of the articulated piston skirt, the monobloc piston has a skirt which is formed as one piece with the pin bosses as an integral structure of the lower crown part.

The invention has the advantages of providing upper and lower crown parts joined by friction welding to define dual galleries within the piston structure to provide a high integrity connection between the upper and lower crown parts which is superior to brazing or charged carrier rays of the known prior art pistons above having communicating dual oil galleries.

The invention further provides a simple dual gallery structure which is highly effective at cooling the upper region of the piston with cooling oil that circulates within and between the chambers to extract heat from the piston.

Another advantage of the friction welding process employed in joining the upper and lower crown parts is that the inner and outer ribs can be friction welded simultaneously in a single operation.

THE DRAWINGS

These and other features and advantages of the present invention will become more readily appreciated when considered in connection with the following detailed description and appended drawings, wherein.

DETAILED DESCRIPTION

Figure 1:
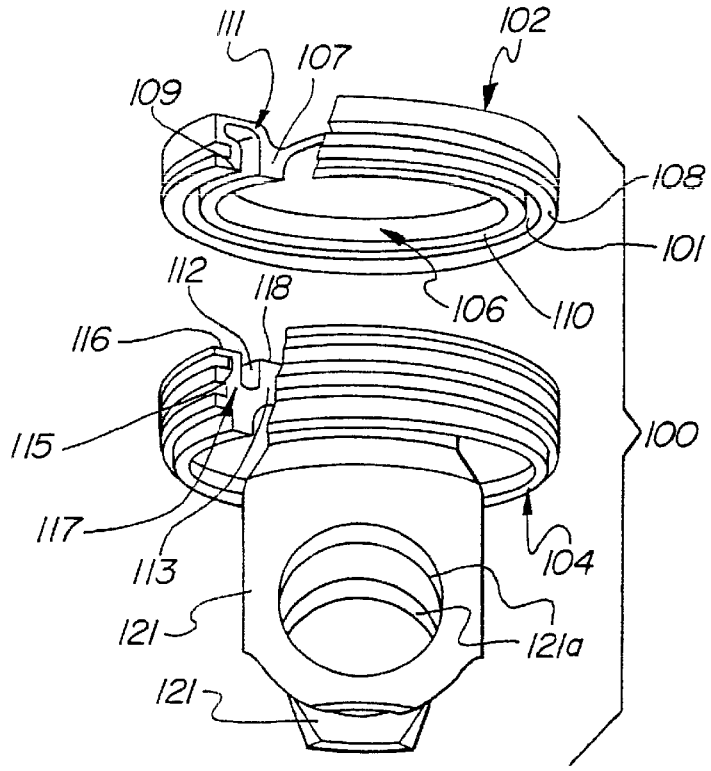
FIG. 1 is a schematic exploded perspective view of an articulated piston body constructed according to a first embodiment of the present invention.
Figure 2:
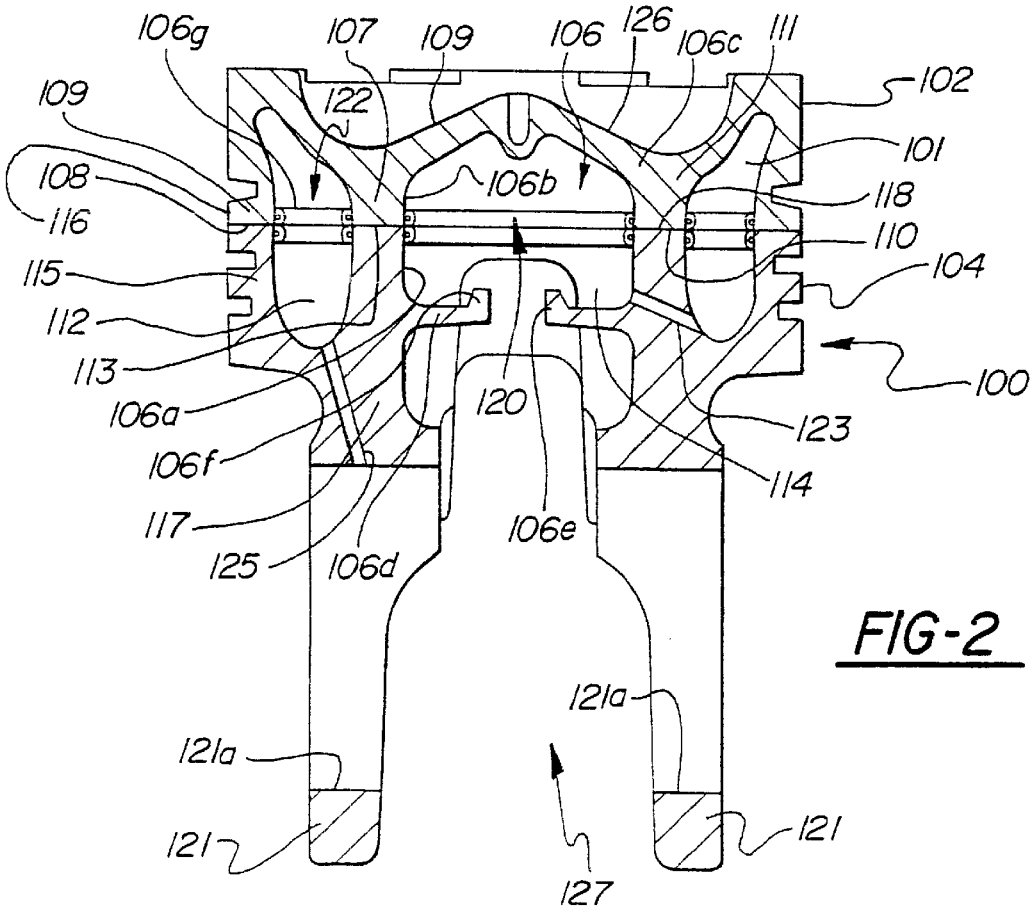
FIG. 2 is a schematic section view of the piston body of FIG. 1.
Figure 3:
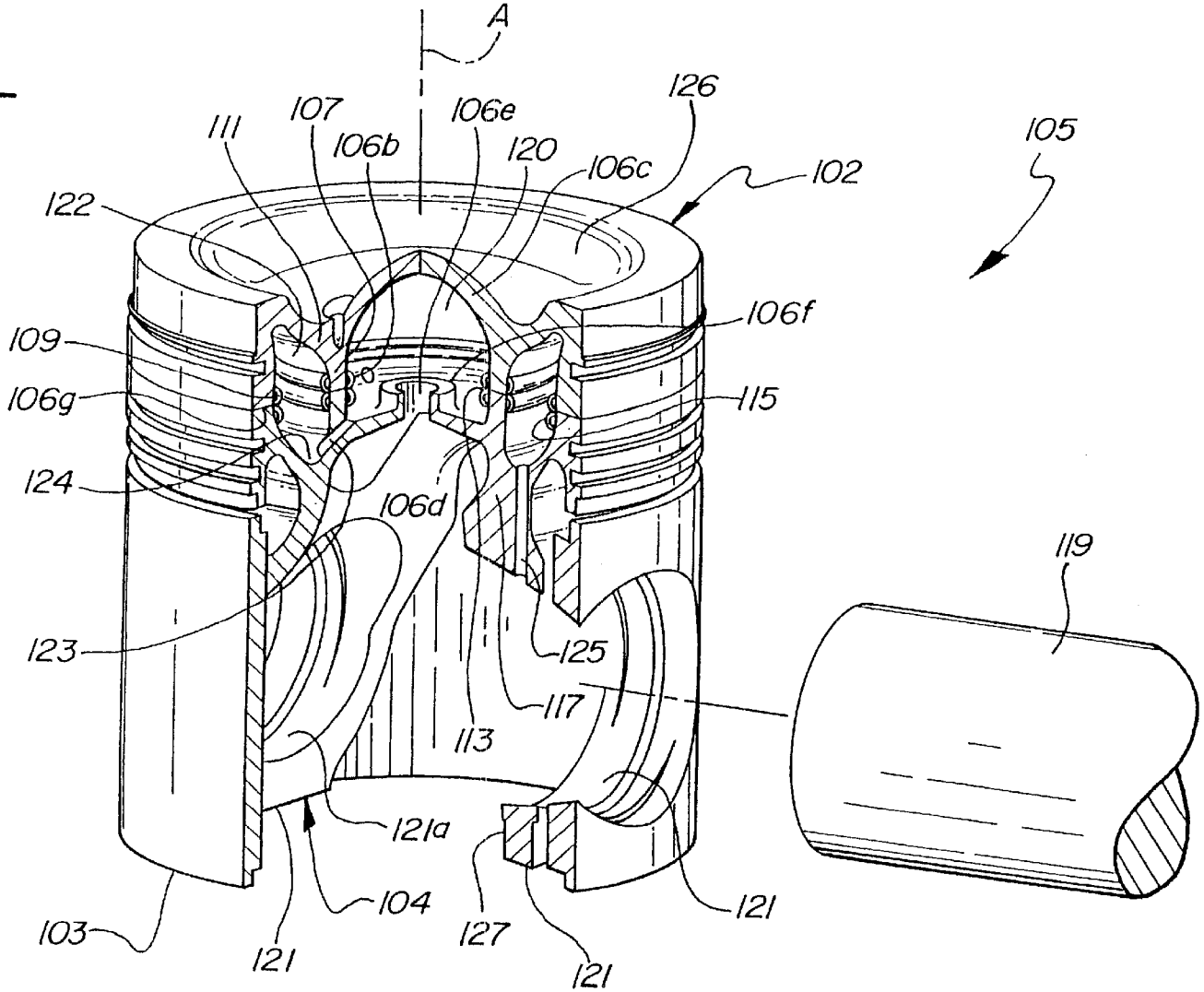
FIG. 3 is a perspective elevational view, shown partly in section, of the completed piston assembly.

Referring initially to FIGS. 1–3, a piston sub-assembly or body 100 according to the invention has an upper crown part 102 and a lower crown part 104 to be connected together and thereafter coupled to an articulated skirt 103 (FIG. 3) to provide a piston assembly 105 of FIG. 3.

To form a preferred dual-gallery structure, the upper crown part 102 is provided with a circumferential annular recess 101 and a central recess 106. The recess 101 is defined by an inner annular rib 107 and an outer annular rib 109 which is spaced radially outwardly of the inner rib 107. The ribs 107, 109 depend from a connecting portion 111 of the upper crown part 102 and extend axially in substantially parallel relation to a longitudinal axis A of the piston body 100 including their wall surfaces adjacent the free ends. A first joining or welding surface 108 is provided at a free end of the outer rib 109 and is disposed around the circumferential annular recess 101 and is preferably flat or planar for mating with a corresponding joining or welding surface 116 provided on the free end of an outer annular rib 115 projecting axially from a connecting portion 117 of the lower crown part 104.

Similarly, a second welding surface 110 is provided on the free end of the inner rib 107 of the upper crown part 102 and borders the recess 101 and is also preferably flat or planar for mating with a corresponding joining surface 118 provided on the free end of an inner rib 113 projecting axially from the connecting portion 117 of the lower crown part 104. The rib 113 extends preferably in generally parallel relation to the axis A of the piston 100. The upper crown part 102 and lower crown part 104 can be made of any known material appropriate to piston structures and suitable for friction welding, such as steel of identical or different compositions. The upper and lower crown parts 102, 104 can be made of a different material than that employed for the piston skirt 105 which may be made of aluminum, for example.

The lower crown part 104 includes pin boss portions 121 depending from the connecting portion 117 and separated by a space 127 formed with pin bores 121*a* in which bushings (not shown) may be disposed for receiving a wrist pin 119 in conventional manner to couple the piston 107 to a connecting rod (not shown) and to couple the articulated skirt 103 to the piston body 100. The lower crown part 104 may also have a circumferential annular recess 112 and a central recess 114, which correspond to the circumferential annular recess 101 and the central recess 106 in the upper crown part 102. The lower crown part 104 may have other recess configurations than that shown as long as the lower crown part 104 has a shape appropriate for friction welding to the upper crown part 102.

To accommodate friction welding of the crown parts 102, 104, the lower crown part 104 has a third welding surface 116 and a fourth welding surface 118. The third welding surface 116 is shaped to mate with the first welding surface 108 on the upper crown 102, and the fourth welding surface 118 is shaped to mate with the second welding surface 110 on the upper crown. Preferably, all of the welding surfaces 108, 110, 116, 118 are flat and planar. The third welding surface 116 is preferably disposed around the central recess 114.

To form the piston sub-assembly 100, the crown 102 and the crown bottom 104 are positioned to align the first and third welding surfaces 108, 116 310 together and the second and fourth welding surfaces 110, 118 together. The welding surfaces 108, 110, 116, 118 then bonded together via friction-welding. For example, the crown 102 and crown bottom 104 can be pressed together and spun about the axis A against each other to generate friction necessary to bond the upper crown part 102 and lower crown part 104 together. Preferably, all of the corresponding welding surfaces 108, 110, 116, 118 are welded together in a single manufacturing step, which can be achieved if all of the welding surfaces 108, 110, 116, 118 mate with each other simultaneously. Because the joining surfaces of the upper crown 102 and lower crown 104 do not have slots, which are often used in other welding processes, the flat surfaces greatly simplify the friction welding process, reducing the manufacturing time.

Once the upper crown part 102 and the lower crown part 104 are friction-welded together to provide friction weld joints 106*b*, 106*g* at the interfaces, the resulting piston sub-assembly 100 has an inner oil gallery 120 and an outer annular gallery 122. The inner gallery 120 is formed by the combined central recesses 106, 114 of the upper crown part 102 and the lower crown part 104, respectively. Similarly, the outer gallery 122 is formed by the combined circumferential recesses 105, 112 of the upper crown part 102 and the lower crown part 104, respectively.

Referring to FIG. 3, a series of transfer holes 123 are provided in the inner rib 113 and extend between and establish fluid communication of the outer gallery 122 and inner gallery 120. Oil inlet holes 125 extend from the pin boss opening 121*a* into the outer gallery 122. The transfer holes 123 are spaced axially below the friction weld joints 106*b*, 106*g*.

The inner gallery 120 has a generally dome-shaped configuration and includes a lower cylindrical section 106*a* extending across the friction weld joint 106*b* for ease of alignment and welding. A concave upper section 106*c* extends across and closes the upper end of the gallery 120. A relatively thin annular floor portion 106*d* extends from the lower extremity of the cylindrical section 106*a* and serves to close the bottom portion of the gallery 120. The floor portion 106*d* is formed with a central opening 106*e* communicating externally of the chamber 120 with the space 127 between the pin bosses 101. The opening 106*e* is surrounded by an upstanding annular rim or dam 106*f*. It will be seen from the drawing FIGS. 1–3 that all corners of the chamber 120 are rounded (i.e., where the various wall portions transition into one another and change angle), to prevent the entrapment or accumulation of oil in the corners.

The floor 106*d* is spaced axially below the joining surface 118 of the inner rib 113. The outer gallery 122 has a floor 124 spaced axially below the joining surfaces 116, 118 and preferably below the inner gallery floor 106*d*. The transfer holes 123 extend upwardly at an angle from the outer gallery 122 to the inner gallery 120. The transfer holes 123 are preferably spaced above the floor 124 of the outer gallery 122 in order to retain an amount of cooling oil in the outer gallery 122. The transfer holes 123 preferably enter the inner gallery 120 at floor level.

In operation, cooling oil is pumped through the oil inlet holes 125 under pressure into the outer chamber 122 where it cools the outer oil ring section of the crown 102. From there, the oil flows into the inner gallery 120 through transfer holes 123. As illustrated in the referenced drawings, the holes 123 enter the gallery 120 at or near the floor portion 106*d*, and preferably in the corner transition region between the floor 106*d* and the cylindrical portion 106*a*. The holes 123 are thus formed in the lower crown portion 104 below the weld joint 106*b*. The upward angle of the transfer holes 123 helps move the oil from the outer gallery 122 to the inner gallery 120. As the piston 105 reciprocates, the oil on the downstroke of the piston 105 is launched relatively upwardly where some of the oil enters and passes with considerable velocity and turbulence through the transfer holes 123 and into the inner gallery 120.

An outer surface 126 of the crown section 106*c* is contoured to provide a bowl configuration exposed to hot combustion gases in operation. During the up and down reciprocating movement of the piston 105, the oil in the inner 120 and outer 122 galleries is splashed about with a "cocktail" shaker action to cool the walls of the chambers 120, 122 to extract heat therefrom. The rim 106*f* contains a certain volume of the oil within the inner chamber 120 when at rest and allows oil above the level of the dam 106*f* to drain from the chamber 120 through the drain hole 106*e* where it falls back to the crank case (not shown).

The friction-welded joint 106*b*, 106*g* between the upper crown part 102 and the lower crown part 104 ensures maximum structural integrity of the piston sub-assembly 100. The friction weld also prevents potential loosening between the upper crown part 102 and the lower crown part 104 due to the different expansion rates of the different materials.

Figure 4:
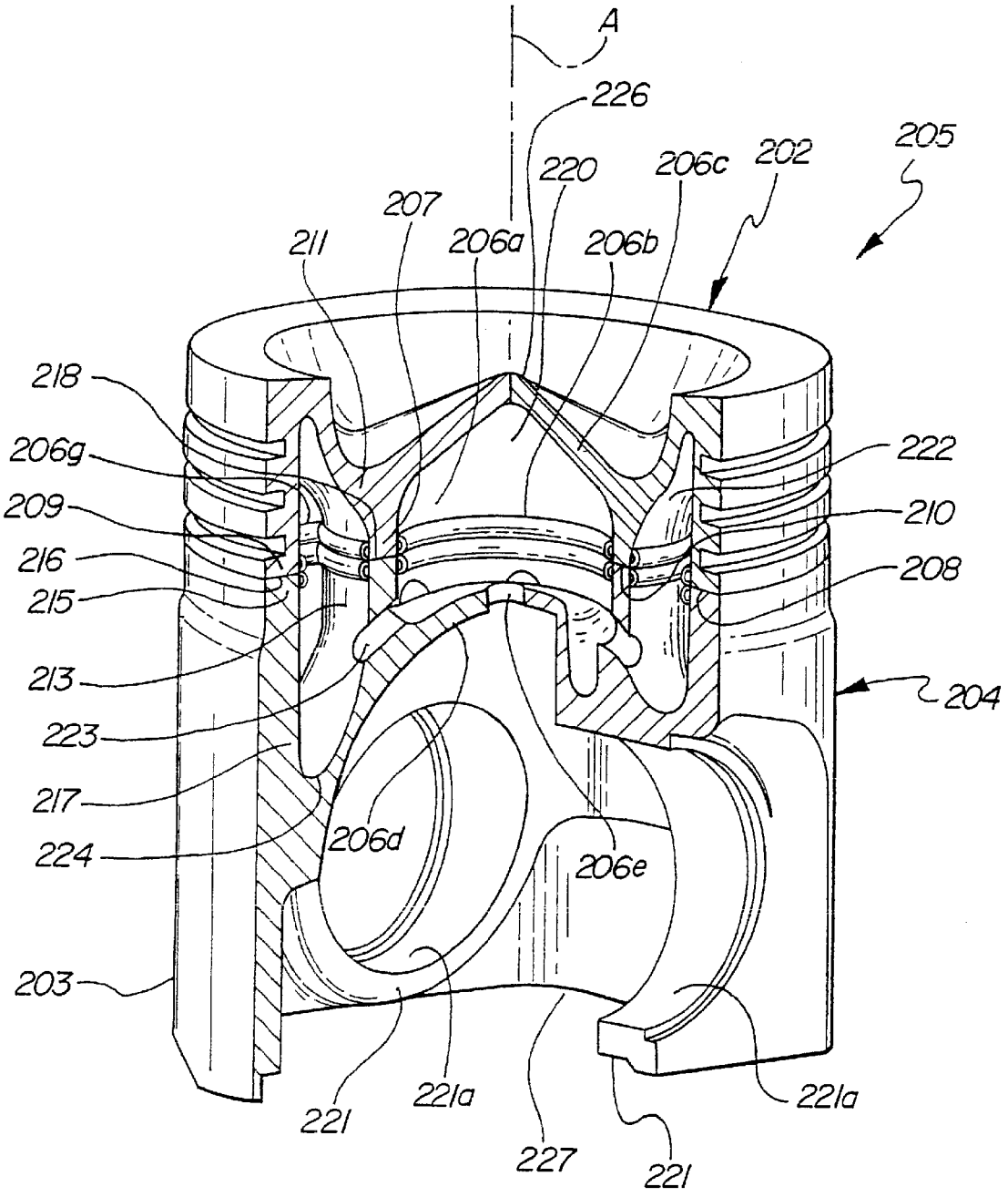
FIG. 4 is a perspective elevational view of a piston constructed according to an alternative embodiment of the invention.

FIG. 4 illustrates an alternative embodiment of the invention wherein like reference numerals are used to represent like features but are offset by 100 (i.e., in the 200 series). The piston 205 is of a monobloc construction, wherein the skirt 203 is fabricated as one unitary piece with the lower pin boss portion 221, such as casting or forging to provide a unitary lower crown/skirt portion CS. The unitized portion CS and upper crown section 202 are joined across the same type of co-planar mating surface 208, 210, 216, 218 at friction weld joints 206*b*, 206*g*, to provide similar inner 220 and outer 222 chambers having similar wall portions, passages, holes, etc., with the flow of oil through the chambers 220, 222 being the same. It will be seen from FIG. 4 that the floor portion 206*d* of the central chamber is convex dome-shaped, such that the oil runs radially outwardly toward the lower peripheral corner regions 206*g*, which resides below the level of the central drain hole 223. As such, the rim 206*f* is not needed for containing a certain volume in the chamber 220. The convex geometry of the floor portion 206*d* achieves this.

The floor 224 of the outer gallery 222 preferably extends into the skirt 203 and preferably below the apex or upper margin (i.e., highest point) of the pin bores 221*a*, as shown in FIG. 4. The port 223 is well above the floor 224 yet is still set at the upward angle.

Accordingly, the present invention provides a dual gallery piston and manufacturing method wherein upper and lower sections are joined by welding and internally configured to provide inner and outer oil cooling chambers that are in flow communication with one another. The friction joint allows increases flexibility in distributing mechanical loads and selecting the size and location of the dual oil galleries. Because the piston sub-assembly 100 and skirt are separate in an articulated piston (FIGS. 1–3), they can be made from different materials to create the articulated piston (e.g., an aluminum skirt with a steel sub-assembly 100).

The disclosed embodiments are representative of presently preferred forms of the invention, but are intended to be illustrative rather than definitive thereof The invention is defined in the claims.

What is claimed is:

1. An articulated piston assembly for heavy duty diesel engine applications comprising:

a piston body including a one piece upper crown part and a one piece lower crown part;

an articulated piston skirt provided as a separate structure from said piston body;

said upper crown part having a lower connecting portion formed with an inner annular rib and an outer annular rib spaced from said inner rib, said inner and outer ribs of said upper crown part extending axially to free ends thereof each presenting a joining surface of said upper crown part ribs;

said lower crown part having an upper connecting portion from which a pair of pin boss portions depend having a space between said pin bosses to receive a connecting rod, said upper connecting portion having an inner annular rib and an outer annular rib spaced from said inner rib of said lower crown member, said inner and outer ribs of said lower crown part extending axially to free ends thereof each presenting a joining surface of said lower crown part ribs;

said lower crown part having an inner gallery floor arranged above said space of said pin bosses and surrounded by said inner annular rib of said lower crown part;

said inner and outer ribs of said upper crown part are joined to said inner and outer ribs of said lower crown part, respectively, across their respective joining surfaces by friction weld joints to define an inner and an outer oil gallery within the joined crown parts separated by said inner ribs of said joined crown parts, said inner rib of said lower crown part being formed with at least one fluid transfer port spaced axially from said joining surface thereof and extending between said outer oil gallery and said inner oil gallery floor including an opening establishing fluid communication between said inner gallery and said space between said pin bosses;

said fluid transfer port of said inner rib extending upwardly at an angle from said outer gallery to said inner gallery;

said outer gallery having a floor extending between said inner rib and said outer rib that is spaced axially from said joining surfaces of said inner and outer ribs of said lower crown part; and said floor of said outer gallery being spaced below said floor of said inner gallery.

2. The assembly of claim 1 wherein said fluid transfer port of said inner rib extends upwardly at an angle from said outer gallery to said inner gallery.

3. The assembly of claim 1 wherein said outer gallery has a floor extending between said inner rib and said outer rib that is spaced axially from said joining surfaces of said inner and outer ribs of said lower crown part.

4. The assembly of claim 1, wherein said upper crown part and said lower part are made of steel.

5. The assembly of claim 1 wherein said inner ribs of said upper and lower crown parts extend substantially parallel to a central longitudinal axis of said upper and said lower crown parts adjacent said joining surfaces.

6. The assembly of claim 5 wherein said outer ribs of said upper and lower crown parts extend substantially parallel to said inner and outer wall surfaces of said inner ribs.

7. The assembly of claim 1 wherein said fluid transfer port extends from a location above said floor of said outer gallery to said floor of said inner gallery at said upward angle.

8. The assembly of claim 1 wherein said floor of said outer gallery is spaced below said opening in said floor of said inner gallery.

9. A monobloc piston assembly for heavy duty diesel engine applications comprising:

a one piece upper crown part and a one piece lower crown part;

said upper crown part having a lower connecting portion formed with an inner annular rib and an outer annular rib spaced from said inner rib, said inner and outer ribs of said upper crown part extending axially to free ends thereof each presenting a joining surface of said upper crown part ribs;

said lower crown part having an upper connecting portion from which a pair of pin boss portions depend having a space between said pin bosses to receive a connecting rod, said lower crown part including an integrated piston skirt formed as one piece with said pin bosses, said upper connecting portion having an inner annular rib and an outer annular rib spaced from said inner rib of said lower crown member, said inner and outer ribs of said lower crown part extending axially to free ends thereof each presenting a joining surface of said lower crown part ribs;

said lower crown part having an inner gallery floor arranged above said space of said pin bosses and surrounded by said inner annular rib of said lower crown part;

said inner and outer ribs of said upper crown part are joined to said inner and outer ribs of said lower crown part, respectively, across their respective joining surfaces by friction weld joints to define an inner and an outer oil gallery within the joined crown parts separated by said inner ribs of said joined crown parts, said inner rib of said lower crown part being formed with at least one fluid transfer port spaced axially from said joining surface thereof and extending between said outer oil gallery and said inner oil gallery to establish fluid communication therebetween, and said inner gallery floor including an opening establishing fluid communication between said inner gallery and said space between said pin bosses;

said fluid transfer port of said inner rib extending upwardly at an angle from said outer gallery to said inner gallery;

said outer gallery having a floor extending between said inner rib and said outer rib that is spaced axial from said joining surfaces of said inner and outer ribs of said lower crown part; and said floor of said outer gallery being spaced below said floor of said inner gallery.

10. The assembly of claim 9 wherein said fluid transfer port extends from a location above said floor of said outer gallery to said floor of said inner gallery at said upward angle.

11. The assembly of claim 9 wherein said floor of said outer gallery is spaced below said opening in said floor of said inner gallery.

12. The assembly of claim 9 wherein said upper crown part and said lower crown part are made of steel.

13. The assembly of claim 9 wherein said inner ribs of said upper and lower crown parts extend substantially parallel to a central longitudinal axis of said upper and said lower crown parts adjacent said joining surfaces.

14. The assembly of claim 13 wherein said outer ribs of said upper and said lower crown parts extend substantially parallel to said inner ribs.

15. The assembly of claim 9 wherein said floor of said outer gallery extends into said skirt.

16. The assembly of claim 15 wherein said pin bosses have pin bores with an upper apex and said floor of said outer gallery extends below said apex.

17. The assembly of claim 9 wherein said outer rib of said lower crown part is formed as an extension of said skirt such that said upper joining surface of said skirt is coupled to said upper crown part across said weld joint of said outer ribs.

18. The assembly of claim 9 wherein said floor of said inner gallery is dome-shaped.

19. A monobloc piston assembly for heavy duty diesel engine applications comprising:

a one piece upper crown part and a one piece lower crown part;

said upper crown part having a lower connecting portion formed with an inner annular rib and an outer annular rib spaced from said inner rib, said inner and outer ribs of said upper crown part extending axially to free ends thereof each presenting a joining surface of said upper crown part ribs;

said lower crown part having an upper connecting portion from which a pair of pin boss portions depend having a space between said pin bosses to receive a connecting rod, said lower crown part including an integrated piston skirt formed as one piece with said pin bosses, said upper connecting portion having an inner annular rib and an outer annular rib spaced from said inner rib of said lower crown member, said inner and outer ribs of said lower crown part extending axially to free ends thereof each presenting a joining surface of said lower crown part ribs;

said lower crown part having an inner gallery floor arranged above said space of said pin bosses and surrounded by said inner annular rib of said lower crown part;

said inner and outer ribs of said upper crown part are joined to said inner and outer ribs of said lower crown part, respectively, across their respective joining surfaces by friction weld joints to define an inner and an outer oil gallery within the joined crown parts separated by said inner ribs of said joined crown parts, said inner rib of said lower crown part being formed with at least one fluid transfer port spaced axially from said joining surface thereof and extending between said outer oil gallery and said inner oil gallery to establish fluid communication therebetween, and said inner gallery floor including an opening establishing fluid communication between said inner gallery and said space between said pin bosses;

said fluid transfer port of said inner rib extending upwardly at an angle from said outer gallery to said inner gallery;

said outer gallery having a floor extending between said inner rib and said outer rib that is spaced axial from said joining surfaces of said inner and outer ribs of said lower crown part; and wherein said floor of said outer gallery extends into said skirt.

20. The assembly of claim 19 wherein said pin bosses have pin bores with an upper apex and said floor of said outer gallery extends below said apex.

21. The assembly of claim 19 wherein said outer rib of said lower crown part is formed as an extension of said skirt such that said upper joining surface of said skirt is coupled to said upper crown part across said weld joint of said outer ribs.

22. The assembly of claim 19 wherein said floor of said inner gallery is dome-shaped.

23. A monobloc piston assembly for heavy duty diesel engine applications comprising:

a one piece upper crown part and a one piece lower crown part;

said upper crown part having a lower connecting portion formed with an inner annular rib and an outer annular rib spaced from said inner rib, said inner and outer ribs of said upper crown part extending axially to free ends thereof each presenting a planar joining surface of said upper crown part ribs;

said lower crown part having an upper connecting portion from which a pair of pin boss portions depend having a space between said pin bosses to receive a connecting rod, said lower crown part including an integrated piston skirt formed as one piece with said pin bosses, said upper connecting portion having an inner annular rib and an outer annular rib spaced from said inner rib of said lower crown member, said inner and outer ribs of said lower crown part extending axially to free ends thereof each presenting a planar joining surface of said lower crown part ribs;

said lower crown part having an inner gallery floor arranged above said space of said pin bosses and surrounded by said inner annular rib of said lower crown part;

wherein said inner and outer ribs of said upper crown part are joined to said inner and outer ribs of said lower crown part, respectively, across their respective joining surfaces by friction weld joints to define an inner and an outer oil gallery within the joined crown parts separated by said inner ribs of said joined crown parts, said inner rib of said lower crown part being formed with at least one fluid transfer port spaced axially from said joining surface thereof and extending between said outer oil gallery and said inner oil gallery to establish fluid communication therebetween, and said inner gallery floor including an opening establishing fluid communication between said inner gallery and said space between said pin bosses; and wherein said outer rib of said lower crown part is formed as an extension of said skirt such that said upper joining surface of said skirt is coupled to said upper crown part across said weld joint of said outer ribs.

24. A monobloc piston assembly for heavy duty diesel engine applications comprising:

a one piece upper crown part and a one piece lower crown part;

said upper crown part having a lower connecting portion formed with an inner annular rib and an outer annular rib spaced from said inner rib, said inner and outer ribs of said upper crown part extending axially to free ends thereof each presenting a planar joining surface of said upper crown part ribs;

said lower crown part having an upper connecting portion from which a pair of pin boss portions depend having a space between said pin bosses to receive a connecting rod, said lower crown part including an integrated piston skirt formed as one piece with said pin bosses, said upper connecting portion having an inner annular rib and an outer annular rib spaced from said inner rib of said lower crown member, said inner and outer ribs of said lower crown part extending axially to free ends thereof each presenting a planar joining surface of said lower crown part ribs;

said lower crown part having an inner gallery floor arranged above said space of said pin bosses and surrounded by said inner annular rib of said lower crown part;

wherein said inner and outer ribs of said upper crown part are joined to said inner and outer ribs of said lower crown part, respectively, across their respective joining surfaces by friction weld joints to define an inner and an outer oil gallery within the joined crown parts separated by said inner ribs of said joined crown parts, said inner rib of said lower crown part being formed with at least one fluid transfer port spaced axially from said joining surface thereof and extending between said outer oil gallery and said inner oil gallery to establish fluid communication therebetween, and said inner gallery floor including an opening establishing fluid communication between said inner gallery and said space between said pin bosses; and wherein said floor of said inner gallery is dome-shaped.

* * * * *